United States Patent [19]

Creith

[11] 4,130,216

[45] Dec. 19, 1978

[54] PERIPHERAL SEAL FOR FLOATING ROOFS

[75] Inventor: Lou C. Creith, Allentown, Pa.

[73] Assignee: Altech Industries, Inc., Allentown, Pa.

[21] Appl. No.: 784,953

[22] Filed: Apr. 5, 1977

[51] Int. Cl.[2] ..... B65D 87/20

[52] U.S. Cl. ..... 220/224; 220/222

[58] Field of Search ..... 220/216–227

[56] References Cited

U.S. PATENT DOCUMENTS

| | | | |
|---|---|---|---|
| 2,459,178 | 1/1949 | Moyer | 220/224 |
| 2,540,801 | 2/1951 | Wiggins | 220/224 |
| 2,784,863 | 3/1957 | Fabian | 220/224 |
| 2,897,998 | 8/1959 | Ulm | 220/224 |

*Primary Examiner*—William Price
*Assistant Examiner*—Steven M. Pollard
*Attorney, Agent, or Firm*—Miller & Prestia

[57] ABSTRACT

A novel peripheral seal for sealing a liquid storage tank of the type having welded, riveted, or bolted, cylindrically shaped side walls includes a floatable pontoon, and a plurality of seal support arms successively and radially disposed about the pontoon periphery. Each support arm is pivotally connected to a pontoon side. A plurality of arcuately shaped primary seals span from one support arm to the next successive support arm and are biased raidally outwardly to sealingly engage the riveted sidewalls. A fabric membrane spans from support arm to support arm and extends from a primary seal to the pontoon to form an annular cover. The support arms are interconnected by flexible connection means to provide stability, and limited circumferential movement thereof. The flexible connection means also allows each support arm to move radially inwardly and outwardly, by itself, to a certain degree.

For optimal sealing results, arcuately shaped secondary seals may be disposed below the primary seal on the support arms to effect a double seal.

13 Claims, 8 Drawing Figures

PERIPHERAL SEAL FOR FLOATING ROOFS

BACKGROUND OF THE INVENTION

1. Field of the Invention

This invention relates to an improved peripheral seal for use in liquid storage tanks wherein the tank sidewalls are welded, riveted, or bolted, and are cylindrically shaped.

2. Description of Prior Art

Petroleum products and hydrocarbon liquids, in general, are commonly stored above ground in large cylindrical storage tanks. Those having vapor pressures less than one atmosphere are usually stored in tanks having fixed roofs or floating roofs which rise and fall with the liquid. Since the products stored are often volatile, it is, in such cases, necessary to prevent loss of the vapors which come off the liquid, to minimize losses and to prevent contamination of the atmosphere. An improved method of vapor loss control is a floating cover which closes off the surface of the stored product, thus preventing evaporation. A floating roof fulfills this requirement. For fixed roof tanks, it is common practice to install a floating cover inside the tank to perform that function. These floating covers and roofs, are, in themselves impermeable to the vapors contained. Being made normally of metal or plastic and being rigid in nature, it is necessary to leave an annular space around the floating device (floater) to prevent interference between it and the tank wall in case of irregularity of shape in either member. It is then necessary to close up the annular space with a flexible seal which is connected and sealed to the floater and which pushes sealingly against the tank wall as the floater rises and falls.

To date, a number of designs of such seals have been employed, all of which suffer to some extent in their ability to provide a positive seal under all the conditions encountered in the field. For instance, the following prior art patents all disclose varying seal structures for use in vertical storage tanks:

U.S. Pat. Nos.
3,595,432—Ven der Heijden et al.
3,059,805—Joor
2,987,215—Joor
2,784,863—Fabian
2,459,178—Moyer
2,313,856—Wiggins
2,148,811—Griffin
2,082,194—Wiggins
1,979,657—Wiggins Basically the prior art discloses a series of formed metal shoes arranged end to end around the periphery of the floater that are pressed flat against the tank wall by means of connecting arms with springs or weights, all of these elements being connected to the floater. The space between the upper edge of the sealing plates and the outer rim of the floater is closed up with a strip of fabric connected to the floater rim and to the upper edges of the plates.

Also, other sealing devices are known wherein the annular space is closed by placing into it a fabric tube somewhat larger in diameter than the width of the space, with the tube being filled either with liquid or with resilient foam to provide the sealing pressure against the tank wall. The fabric tubing is, of course, connected to the outer rim of the floater.

Both types of seals work well in tanks with relatively smooth, regular, walls. However, in lap welded tanks or bolted or riveted tanks, the sealing effect is adversely affected and the protrusions cause excessive wear. Further, the protrusions cause the formation of openings between the seal and the tank wall which often places the system in an unacceptable category insofar as the Environmental Protection Agency is concerned.

Accordingly, it is an object of the present invention to provide an improved peripheral seal useful for sealing liquid storage tanks having cylindrical walls, sometimes irregularly shaped and with randomly occurring protrusions such as rivets, bolts, or lap-welded seams.

SUMMARY OF THE INVENTION

These and other problems inherent in the prior art are solved by the system proposed herein. The novel seal utilizes not only a flexible seal member or members which press against the tank wall, but also a support system which has mobility radially as well as axially. The two modes working together will provide greater ability to move sealingly over minor protrusions and major misalignments in the tank wall. The proposed system will provide an acceptable sealing effect over considerably greater misalignment than any existing system.

A better understanding of the invention will be gained by reading the following detailed description with reference to the attached drawings.

DETAILED DESCRIPTION OF THE PREFERRED EMBODIMENTS

Figure 1:
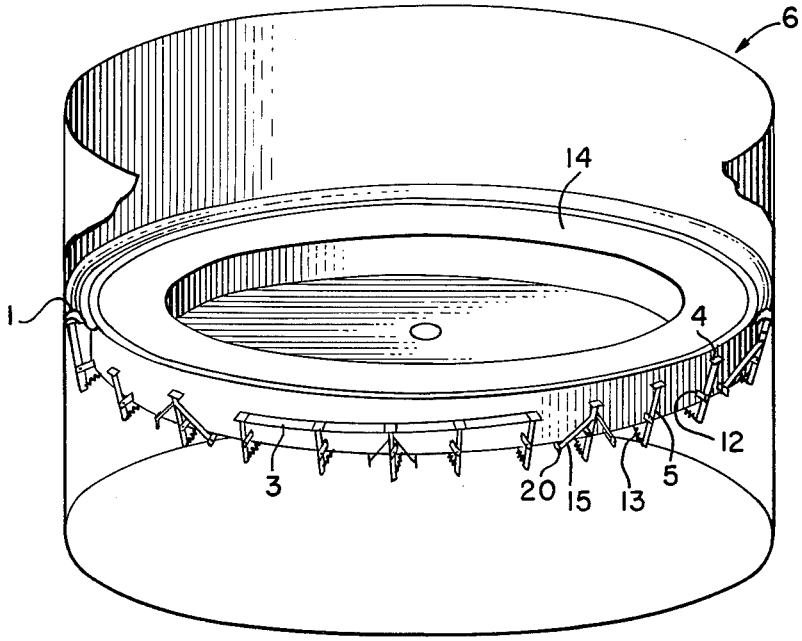
FIG. 1 is a perspective view of the novel sealing apparatus with part of the tank sidewall cut away for simplification.
Figure 2:
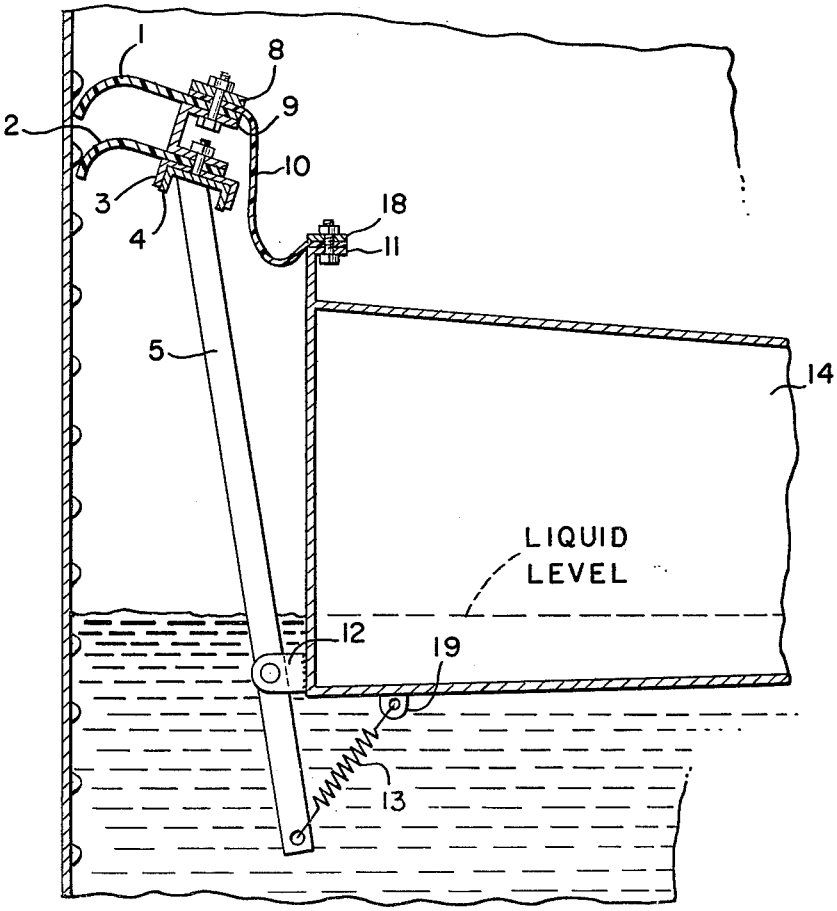
FIG. 2 is a partially cut-a-way enlarged detailed view of one preferred embodiment of the apparatus, showing the construction and relationship between sealing members, pontoon and support arm.

With reference to the drawings, and specifically to FIGS. 1 and 2 thereof, there is shown storage tank 6, with pontoon 14 floatably disposed therein. The pontoon is fitted with a peripheral seal of the type proposed and consisting of wiper seal support arm 5, support arm end plate 4, seal support plate 3, support arm lug 12, and seal pressure spring 13. As can be seen, pontoon 14 is provided with a top, bottom, and sides.

FIG. 2 illustrates the sealing mechanism as it will be when in service, as pressed against the tank wall. As can be seen in FIG. 2, seal support arm 5 is pivotally attached to the pontoon side at lug 12. A support arm end plate 4 is mounted on the top support arm side, and serves as a base so that the primary seal 1 can be attached thereto. In this embodiment, primary seal 1 and secondary seal 2 are both provided to insure optimum sealing engagement of the seal members to the cylindrically shaped sidewall. Secondary seal 2 is bolted between spacer plate 9 and seal support plate 3. Seal support plate 3 extends between successive support arms (as seen in FIG. 1), and is mounted on seal support end plate 4. Primary seal 1 is mounted on the top of the generally channel shaped spacer plate 9 and is bolted between the spacer plate 9 and clamp ring 8.

Primary seal 1 is generally arcuately shaped, and extends between successive support arms. Seal 1 is horizontally disposed so as to flushly engage the sidewall along a generally horizontal plane.

Fabric membrane 10 extends from the top of the pontoon to the primary seal 1, and extends between successive primary seals to form an annular cover spanning the space between the primary seal and pontoon top. Coiled tension spring 13 is attached to the bottom end of support arm 5 through an eye formed in the bottom of the support arm. The other end of the tension spring is attached to the bottom of the floating pontoon. The tension spring thus forms a means for biasing the seal radially outwardly to effect a sealing engagement of the seal members to the tank sidewall.

A thin plate may be placed under fabric membrane 10 at each seal support arm location to bridge the gap between successive seal support plates 3, thereby aiding in the prevention of vapor escape that may occur through the ripple in the fabric formed at each support arm location.

Figure 3:
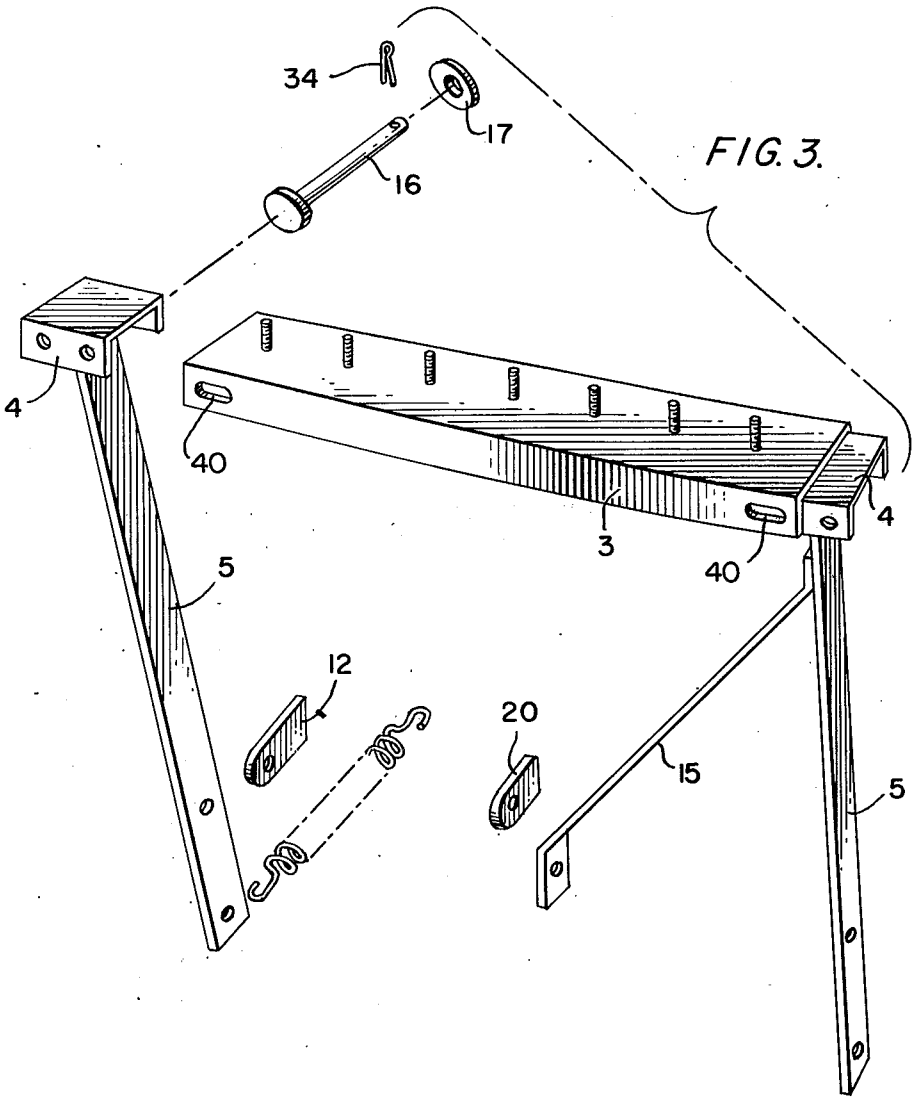
FIG. 3 is an exploded view of one embodiment of the seal support and compression spring mechanism.

FIG. 3 illustrates an exploded view showing two support arms 5 with end plates 4 mounted thereon. Seal support plate 3 is attached at both ends to successive support arm end plates. One end of support arm diagonal 15 is attached to support arm 5, while the other support arm diagonal 15 is connected to lug 20 that will be attached to the pontoon understructure.

Figure 4:
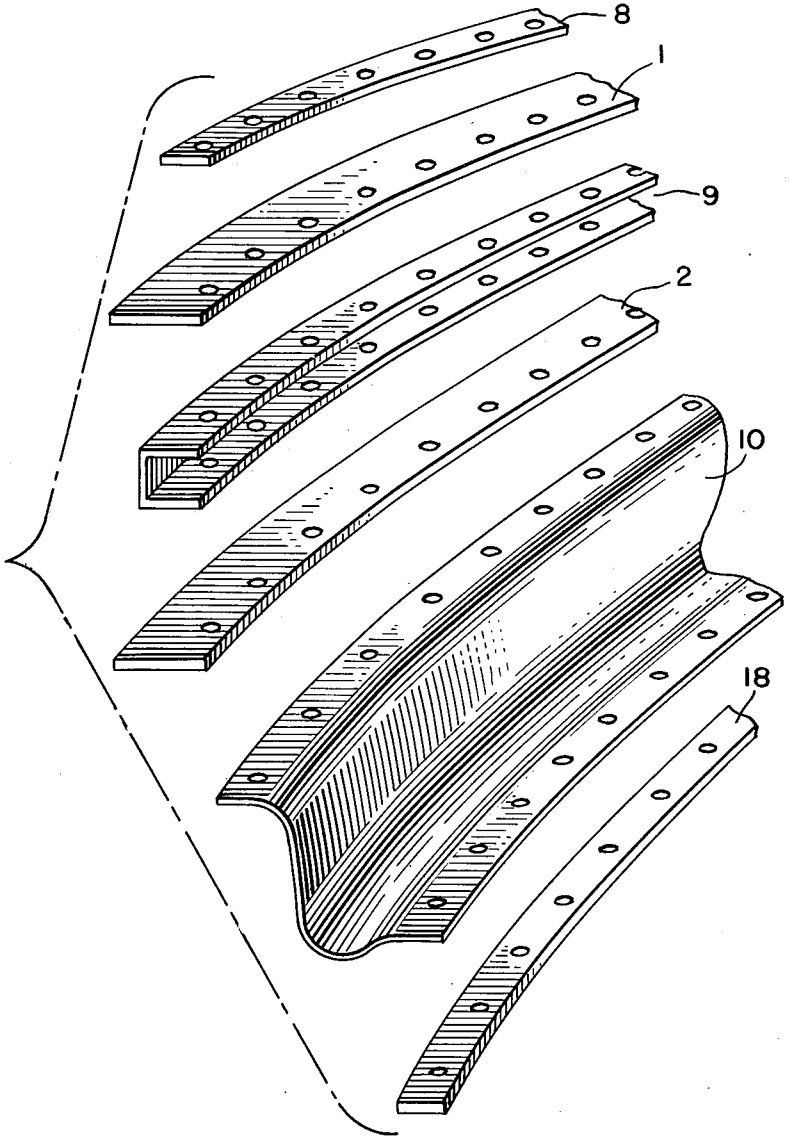
FIG. 4 is an exploded view of one embodiment of the sealing members and the means for attaching the sealing members to the seal support structure.

FIG. 4 shows the actual relationship between the sealing members. Items 1 and 2 are the seals, which are pressed against the tank wall and do the actual sealing. These members will be made of a resilient, normally elastomeric material such as butadiene rubber, a fluoro elastomer, polyethylene foam or similar material preferably in the closed cell foam configuration. The materials will vary and must be compatible, of course, with the chemical being stored and the atmospheric conditions to which it is exposed. The double configuration of seal members is contemplated for use only when special conditions require it, such as in riveted or bolted tanks. Normally, seal 1 is required only. The numeral 10 designates the fabric membrane by which the space between the floater rim and the primary seal is closed off. The fabric should be chosen with the same factors as considered in choosing the seals 1 and 2 in mind. Item 9 is a spacer used to hold down and separate primary seal 1 from secondary seal 2, and it is required only when a double seal is used. Items 8 and 18 are holding means used to clamp seal 1 and fabric membrane 10 in place.

Figure 5:
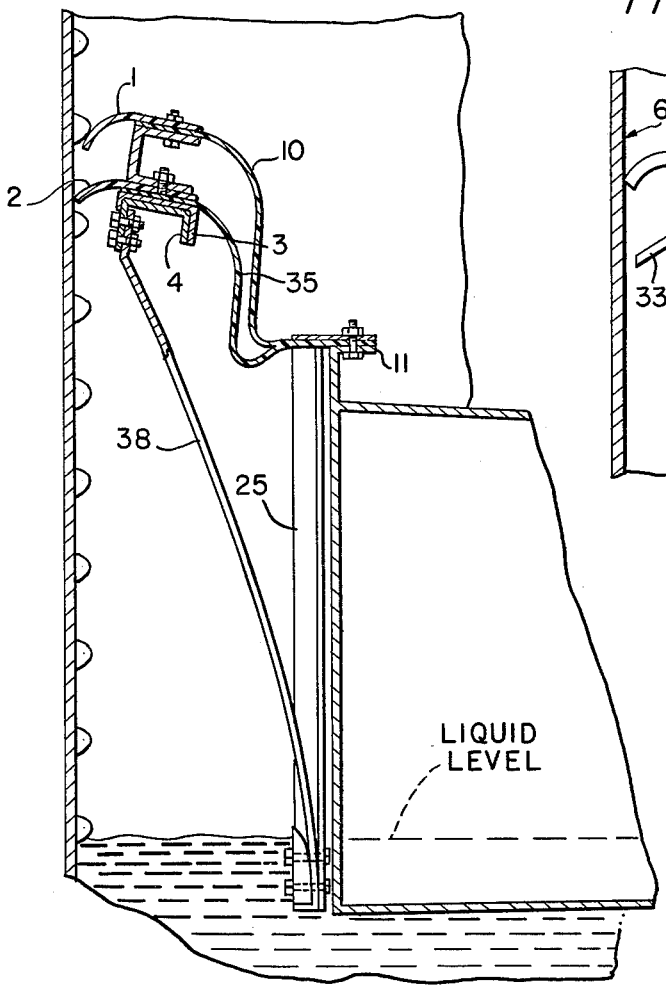
FIG. 5 is a partially cut-a-way enlarged detailed view of another embodiment, showing the relationship between the sealing member, pontoon, and support arm.

FIG. 5 is a view of another embodiment. Here, the seal support arm itself is a leaf spring 58. It can be made as a straight leaf, thereby requiring a triangular shaped spacer between itself and the unit support arm 25, at the bottom, or it can be a curved leaf spring as shown in the drawing. In either case, it will be arranged so that it will be able to, and in fact, would tend to make the sealing means move several inches to the left, as shown, unless restrained by the tank wall 6. As can be seen in the figure, unit support arm 25 is mounted along the pontoon side portion.

As further seen in FIG. 5, a secondary fabric membrane 35, can be provided to span between successive support arm locations, and to extend from the secondary seal to the pontoon rim. This membrane provides a second annular cover.

Figure 6:
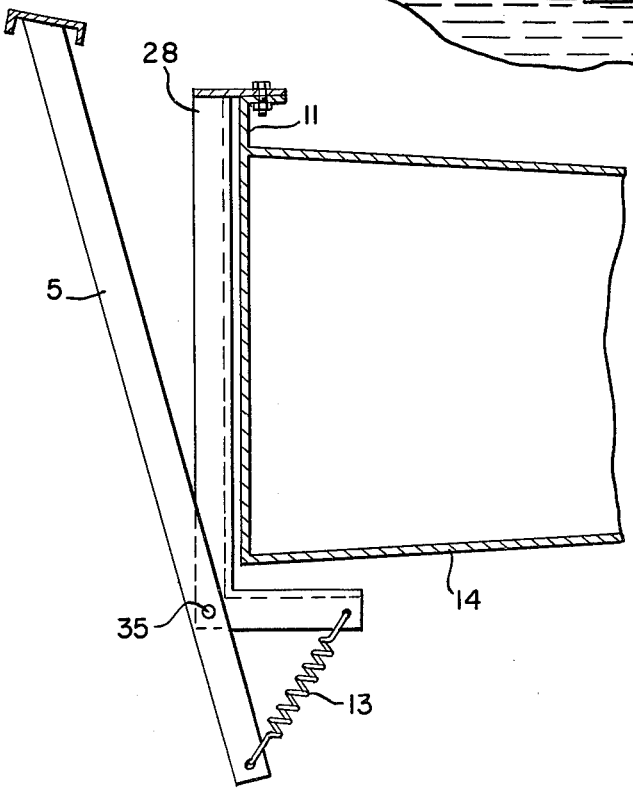
FIG. 6 is a partially cut-a-way enlarged detailed view of yet another embodiment, again showing the relationship between the sealing members, pontoon, and support arm.

A further variation of the sealing device is shown in FIG. 6 wherein the seal support arm 5 and the spring 13 are attached to and supported by an L-shaped support bracket 28, which is attached by bolts to a bracket 11 around the upper rim of the pontoon 14. As shown, pivot pin 35 extends through support arm 5 and support bracket 28 to act as a fulcrum. This embodiment makes it unnecessary to weld a hinge bracket and spring anchor to the pontoon, and, thus, permits the entire system to be installed or removed from above without taking the tank out of service. With this system, each support unit would be preassembled, dropped into place and folded down, ready for installation of the sealing means.

Figure 7:
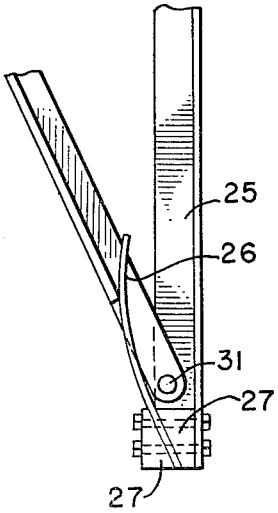
FIG. 7 is an enlarged detailed view of still another embodiment showing the pivotal connection of a support arm to a unit support arm, and showing means for biasing the seal radially outwardly.

A further variation of the sealing device is shown in FIG. 7 which depicts a detail view of the bottom end of seal support arm 5. In this embodiment, support arm 5 is fastened to the unit support arm 25 by hinge pin 31. Support arm 25 extends vertically along the pontoon side, and is mounted to bracket 11 by a bolt or the like. Mounted below the hinge pin is a short leaf spring 26, which is fastened between two triangular blocks, 27, which sit at an angle such that it supports a force to the left when engaged with the steel support arm, as shown. By carefully locating the hinge pin of item 5 and the contact point between item 5 and the leaf spring 26, this system can be arranged so that the spring will exert an almost constant force on the seal support arm throughout its travel.

Figure 8:
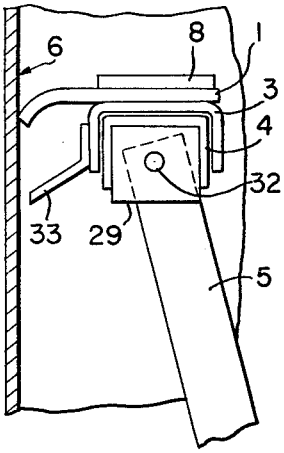
FIG. 8 is a partially cut-a-way enlarged detailed view of one embodiment of the support arm-seal relationship having a scraper blade disposed below the primary seal member.

FIG. 8 depicts a variation of the device wherein seal support arm end plate 4 is pivotally connected to the support arm 5 by means of two mounting lugs 29, which straddle the support arm 5 and the hinge pin 32. This allows the entire support arm end plate 4, seal support plate 3, and sealing means to rotate or pivot several degrees as the liquid level in the tank causes the entire system to rise or fall. As the level rises, the sealing head, items 1, 3, 4, 29 and 30, all rotate counterclockwise due to a downward frictional force transmitted from tank wall 6 to sealing means 1. As the level falls, the frictional force will cause the head to rotate in a clockwise direction. In each case, the travel will be stopped by the bottom edge of the support arm end plate contacting a stop on the support arm 5. Arm 5 itself might also serve as a stop.

When a scraping blade 33 is mounted on the bottom edge of the seal support plate 3 it will automatically be pressed against the wall as the liquid level falls and the sealing head rotates clockwise. In this position, any was adhering to the tank wall will be scraped down. As the level rises and the sealing head rotates counterclockwise, scraping blade 33 will move away from the tank wall, thereby passing over any wax adhering to the wall. This characteristic is useful when storing products such as waxy crude oils that tend to build up deposits on the tank wall. In such cases it is normally necessary to scrape the walls only on the downward cycle, and it is desirable to have a scraper pass over the deposits on the upward cycle. Should scraping in both directions be desired, it can be accomplished easily by fastening the sealing head to the support arm 5 with the scraping blade in the fully clockwise rotated position.

In operation, the moving components of the seal system are supported on the pontoon by means of items 11, 12 and 19, all of which are welded or bolted to the periphery of the floater, as shown in FIG. 2. The geometry of the annular space and pontoon will determine the required dimensions of seal components. The length of the seal support arm, item 5, must be such that the angle between it and the outer wall of the pontoon will never be so great as to permit the arm and seal to become jammed. The greatest this angle should become will be about 30°. When held to that limit, jamming should never occur.

In normal operation, the relative positions of the components will be about as depicted in FIG. 2. The primary and secondary seals, 1 and 2, supported on seal support plate 3, are pressed sealingly against the tank wall. Seal support plates 3 are flexibly supported by the seal support arms and support arm end plates. The seal support plates are flexibly connected to the support arm end plate, by means of a capped pin, washer and a cotter pin, depicted in FIG. 3, items 16, 17 and 34. The capped pins are inserted through slotted openings 40 in the seal support plates 3, and through round holes in the support arm end plates 4. The slotted openings 40 permit flexibility in the connection between the seal support plate and the support arm and permit circumferential adjustment of each support arm end plate relative to a support arm end plate adjacent thereto within a limit defined by the width of the slot. This allows each support arm to rotate individually outwardly or inwardly within limits to compensate for major irregularities in the tank wall. The force causing the support arm to move outwardly is provided by the seal compression springs 13, which will be installed so as to be in tension throughout the proposed range of travel of the seal support arm 5. The outer limit of travel of the support arm can be set either by the width of the fabric used to make membrane 10, or by a mechanical stop, not depicted.

In normal operation, as the pontoon rises, the seal support arms will tend to rotate toward the tank wall due to the downward frictional force on the primary seals. However, the length of the support arms will keep the angle between them and the pontoon outer side wall to an acceptable minimum, which will prevent jamming. As the pontoon level falls, the support arms will tend to rotate inwardly but will be prevented from doing so by the sealed compression springs 13. However, the geometry of the system will be such that the primary seals will be held in contact with the tank wall and continue to provide an efficient sealing action over a much greater range of inward and outward movement than is possible by any other systems in use at the present.

Rotation of the seal support arms in a sideward, or circumferential direction is prevented by the use of optional support arm diagonal brackets, 15, as shown in FIG. 3, that can be used at every third support arm location, as illustrated in FIG. 1. The brackets are anchored to the bottom side portion of pontoon 14 at lug 20.

Use of this improved seal system is contemplated on all types of floaters, whether internal or external, and whether high profile steel pontoons or lower profile lightweight pontoons. Further, the use of other forms of compression springs is contemplated in place of the coil tension springs shown, particularly when used on the lower profile, lightweight pontoon.

It shall be apparent to those skilled in the art that many variations and equivalents of the members disclosed in the present invention can be utilized all without departing from the true spirit and scope of the appended claims.

I claim:

1. Apparatus for sealing a liquid storage tank of the type having welded, riveted or bolted cylindrically shaped sidewalls comprising:

(a) a generally annular pontoon member floatably disposed within the tank, said pontoon including sides, base and top;

(b) a plurality of seal support arms, each pivotally connected to the outer side of said pontoon, said arms being generally vertically disposed, successively and radially about the periphery of said pontoon, the bottom end of each of said arms extending toward the tank bottom and the top end of each arm extending above said liquid;

(c) a plurality of support arm end plates, each mounted on a support arm top;

(d) a plurality of arcuately shaped primary seals attached to successive arm end plates, said seals adapted to sealingly mate with said cylindrically shaped sidewalls;

(e) a plurality of fabric membranes, each membrane extending between and attached to a primary seal and the pontoon, said membranes being disposed between successive radially disposed support arms to form an annular cover;

(f) biasing means for biasing said seals radially outwardly to effect a sealing engagement of said seals with said sidewalls;

(g) means flexibly connecting each of said support arm end plates to adjacent successive support arm end plates while allowing limited pivotal movement of each said support arm so that each support arm may, within limits, move inwardly and outwardly toward and away from the tank sidewall to compensate for major irregularities in the tank wall.

2. Apparatus as recited in claim 1 further including a plurality of arcuate secondary seals and arcuate spacer members, each spacer being interposed between a primary seal and a support arm end plate and extending between successive support arms, said secondary seal fastened between said end plate and said spacer and extending between successive support arms, said primary seal mounted on top of said spacer.

3. Apparatus as recited in claim 1 wherein said biasing means (f) include a plurality of coiled tension springs, one end of each of said tension springs connected to the bottom end of a seal support arm, the other tension spring end attached to the pontoon bottom.

4. Apparatus as recited in claim 1 further including support arm diagonal brackets, one end of said bracket secured to said support arm, the other end attached to the bottom side portion of the pontoon.

5. Apparatus as recited in claim 1 wherein said flexible connection means (f) comprise a plurality of seal support plates, each plate mounted to successive support arm end plates to extend between successive support arms, each plate being mounted to a support arm end plate through a slotted opening formed in the support plate.

6. Apparatus as recited in claim 5 further including a scraping blade mounted to each support plate at each support arm location, and wherein the seal support arm end plate is pivotally connected to the support arm.

7. Apparatus as recited in claim 2 further including a plurality of second fabric membranes, each of said second membranes extending from and attached to a secondary seal and the pontoon, said secondary membranes being disposed between successive radially disposed support arms to form an annular cover.

8. Apparatus as recited in claim 1 further including unit support arms fixedly attached to and extending vertically along said pontoon side, and wherein said support arms are directly pivotally connected to said unit support arm.

9. Apparatus as recited in claim 8 wherein said biasing means (f) include leaf springs, one end of each of said leaf springs connected to a unit support arm, the other leaf spring end engaging a seal support arm.

10. Apparatus as recited in claim 8 wherein said biasing means (f) include coiled tension springs, one end of each of said tension springs connected to a unit support arm, the other spring end engaging a support arm.

11. Apparatus for sealing a liquid storage tank of the type having welded, riveted or bolted cylindrically shaped sidewalls comprising:

(a) a generally annular pontoon member floatably disposed within the tank, said pontoon including sides, base and top;

(b) a plurality of arcuately shaped primary seals positioned around said pontoon, said seals adapted to sealingly mate with said cylindrically shaped sidewalls;

(c) resilient means for biasing each of said seals radially outwardly to effect a sealing engagement of said seals with the sidewalls, said resilient means comprising a plurality of spring biased seal support arms generally vertically disposed successively about the periphery of said pontoon and connecting each said primary seal to said pontoon;

(d) means flexibly connecting each said support arm to adjacent successive support arms while allowing limited pivotal movement of each said support arm so that each support arm may move inwardly and outwardly, within limits, to compensate for major irregularities in the tank sidewall; and (e) a plurality of fabric membranes, each membrane extending between and attached to a primary seal and the pontoon, said membrane disposed between successively disposed support arms to form an annular cover.

12. Apparatus for sealing a liquid storage tank as recited in claim 11 wherein each said support arm is a leaf spring which produces said spring biasing.

13. Apparatus as recited in claim 1 wherein said biasing means comprises said support arms, each being a leaf spring.

* * * * *